US008831934B2

(12) United States Patent
Harsch

(10) Patent No.: US 8,831,934 B2
(45) Date of Patent: Sep. 9, 2014

(54) SPEECH ENHANCEMENT METHOD AND SYSTEM

(75) Inventor: Samuel Harsch, Ballaigues (CH)

(73) Assignee: Phonak AG, Stäfa (CH)

( * ) Notice: Subject to any disclaimer, the term of this patent is extended or adjusted under 35 U.S.C. 154(b) by 347 days.

(21) Appl. No.: 13/504,680

(22) PCT Filed: Oct. 27, 2009

(86) PCT No.: PCT/EP2009/064142

§ 371 (c)(1),
(2), (4) Date: Apr. 30, 2012

(87) PCT Pub. No.: WO2010/000878

PCT Pub. Date: Jan. 7, 2010

(65) Prior Publication Data

US 2012/0221329 A1 Aug. 30, 2012

(51) Int. Cl.

| | |
|---|---|
| ***G10L 21/00*** | (2013.01) |
| ***H04R 3/02*** | (2006.01) |
| *H04S 7/00* | (2006.01) |

(52) U.S. Cl.

CPC . *H04R 3/02* (2013.01); *H04S 7/301* (2013.01); *H04S 7/305* (2013.01)

USPC ..... 704/225; 709/229; 700/94; 381/96; 381/92; 381/86; 381/20; 381/18; 381/119; 315/291

(58) Field of Classification Search

CPC ..... G10L 21/0272; H04R 3/005; H04R 5/00; G05F 1/00; H04S 1/00

USPC ..... 709/229; 700/94; 381/96, 92, 86, 20, 381/18, 119; 315/291

See application file for complete search history.

(56) References Cited

U.S. PATENT DOCUMENTS

| | | | | |
|---|---|---|---|---|
| 3,697,692 | A * | 10/1972 | Hafler | 381/18 |
| 4,496,021 | A * | 1/1985 | Berlant | 181/152 |
| 4,953,219 | A * | 8/1990 | Kasai et al. | 381/86 |
| 5,398,287 | A * | 3/1995 | Nuijten | 381/96 |
| 5,400,405 | A * | 3/1995 | Petroff | 381/1 |
| 7,333,618 | B2 | 2/2008 | Shuttleworth et al. | |
| 2002/0129151 | A1 * | 9/2002 | Yuen et al. | 709/229 |
| 2004/0005063 | A1 * | 1/2004 | Klayman | 381/1 |
| 2004/0013271 | A1 * | 1/2004 | Moorthy | 381/1 |

(Continued)

FOREIGN PATENT DOCUMENTS

| | | |
|---|---|---|
| EP | 1 691 574 A2 | 8/2006 |
| JP | 60-37899 A | 2/1985 |
| WO | 02/03563 A1 | 1/2002 |

*Primary Examiner* — Michael Colucci

(74) *Attorney, Agent, or Firm* — Roberts Mlotkowski Safran & Cole, P.C.; David S. Safran

(57) ABSTRACT

A method of speech enhancement in a room (10) includes the steps of capturing audio signals from a speaker's voice by a microphone (12), estimating an ambient noise level in the room from the captured audio signals, processing the captured audio signals by an audio signal processing unit (20), estimating a reverberation level, determining the gain to be applied to the captured audio signals by the audio signal processing unit according to a comparison between the estimated ambient noise level and the estimated reverberation level, and generating sound according to the processed audio signals by a loudspeaker arrangement (24) located in the room, wherein the reverberation level is the level of reverberant components of the sound generated by the loudspeaker arrangement.

25 Claims, 6 Drawing Sheets

(56) References Cited

U.S. PATENT DOCUMENTS

2004/0212320 A1* 10/2004 Dowling et al. ..... 315/291
2004/0240680 A1* 12/2004 Rui et al. ..... 381/92
2004/0247132 A1* 12/2004 Klayman et al. ..... 381/1
2005/0071028 A1* 3/2005 Yuen et al. ..... 700/94
2010/0128892 A1* 5/2010 Chen et al. ..... 381/92
2010/0177903 A1* 7/2010 Vinton et al. ..... 381/20
2010/0296672 A1* 11/2010 Vickers ..... 381/119

* cited by examiner

SPEECH ENHANCEMENT METHOD AND SYSTEM

BACKGROUND OF THE INVENTION

1. Field of the Invention

The present invention relates to a system for speech enhancement in a room comprising a microphone for capturing audio signals from a speaker's voice, an audio signal processing unit for processing the captured audio signals and a loudspeaker arrangement located in the room for generating amplified sound according to the processed audio signals.

By using such a system, the speaker's voice can be amplified in order to increase speech intelligibility for persons present in the room, such as the listeners in an audience or pupils/students in a classroom. However, increased amplification does not necessarily result in increased speech intelligibility.

2. Description of Related Art

U.S. Pat. No. 7,333,618 B2 relates to a speech enhancement system comprising, in addition to the speaker's microphone, a second microphone placed in the audience for capturing both the sound generated by the loudspeakers and ambient noise, a variable amplifier and an ambient noise compensation circuit. The output signal of the variable amplifier is compared to the ambient noise level derived from the signals captures by the second microphone, and the gain applied to the signals from the speaker's microphone is adjusted according to the level of the ambient noise.

European Patent Application EP 1 691 574 A2 relates to an FM (frequency modulation) transmission system for a hearing aid, wherein the gain applied to the audio signals captured by the microphone of the FM transmission unit is adjusted in the FM receiver according to the ambient noise level and the voice activity as detected by analyzing the audio signals captured by the microphone. The gain is automatically increased when as it is detected that the speaker is speaking; the gain is also adjusted as a function of ambient noise level.

SUMMARY OF THE INVENTION

It is an object of the invention to provide for a speech enhancement system, whereby speech intelligibility is increased in an efficient manner. It is also an object to provide for a corresponding method of speech enhancement.

According to the invention, these objects are achieved by a speech enhancement method and speech enhancement system as described herein.

The invention is beneficial in that, by determining the gain to be applied to the audio signals captured by the microphone according to a comparison between an estimated ambient noise level and an estimated reverberation level of the sound generated by the loudspeaker arrangement, the signal to noise ratio (SNR) can be optimized at an any time, without applying an unnecessary high gain, thereby increasing speech intelligibility in an efficient manner.

Preferably, the reverberation level is a late reverberation level corresponding to the level of the components of the sound generated by the loudspeaker arrangement having reverberation times above a reverberation time threshold, which threshold is selected such that the late reverberation sound components are perceivable as a hearing sensation separate from perception of the respective non-delayed sound. For example, the reverberation threshold time may be about 50 ms These and further objects, features and advantages of the present invention will become apparent from the following description when taken in connection with the accompanying drawings which, for purposes of illustration only, show several embodiments in accordance with the present invention.

DETAILED DESCRIPTION OF THE INVENTION

Figure 1:
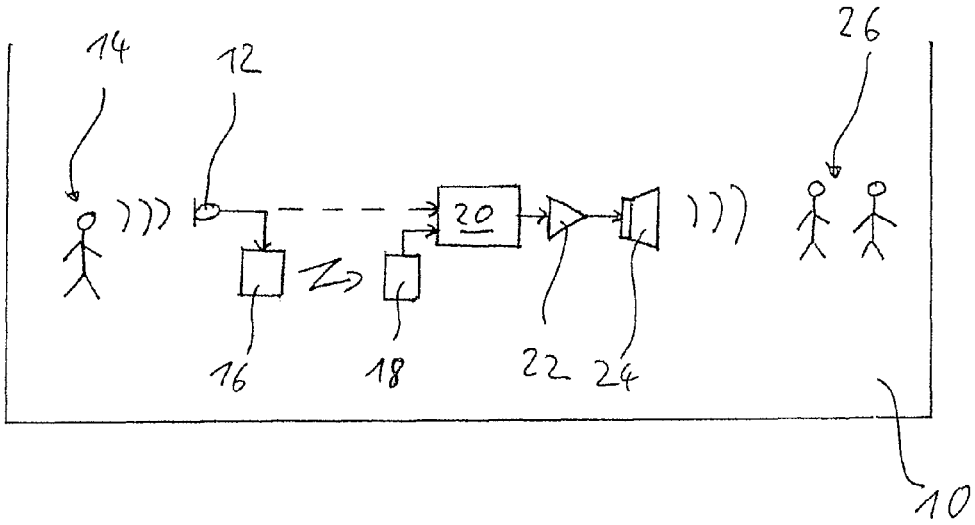
FIG. 1 is a schematic block diagram of a speech enhancement system according to the invention.

FIG. 1 is a schematic representation of a system for enhancement of speech in a room 10. The system comprises a microphone 12 (which in practice may be a directional microphone comprising at least two spaced apart acoustic sensors) for capturing audio signals from the voice of a speaker 14, which signals are supplied to a unit 16 which may provide for pre-amplification of the audio signals and which, in case of a wireless microphone, includes a transmitter for establishing a wireless audio signal link, such as an analog FM link or, preferably, a digital link. The audio signals are supplied, either by cable or in case of a wireless microphone, via an audio signal receiver 18, to an audio signal processing unit 20 for processing the audio signals, in particular to apply spectral filtering and gain control to the audio signals. The processed audio signals are supplied to a power amplifier 22 operating at constant gain in order to supply amplified audio signals to a loudspeaker arrangement 24 in order to generate amplified sound according to the processed audio signals, which sound is perceived by listeners 26.

The purpose of a speech enhancement system in a room is to increase the intelligibility of the speaker's voice. In general, speech intelligibility is affected by the noise level in the room (ambient noise level) and the reverberation of the useful sound, i.e., the speaker's voice, in the room. At least part of the reverberation acts to deteriorate speech intelligibility. The total reverberation signal may be split into an early reverberation signal (corresponding to reverberation times of e.g. not more than 50 ms) and a late reverberation signal (corresponding reverberation times of more than 50 ms). The early reverberation signal is integrated with the direct sound by the human hearing, i.e., it is not perceivable as a separate signal, and therefore does not deteriorate speech intelligibility. The late reverberation signal is not integrated with the direct sound by the human hearing, it is perceivable as a separate signal, and therefore has to be considered as part of the noise.

Hence, the acoustic field in a room may be separated into three parts: (1) the useful signal, i.e., the direct field of the speaker's voice and the respective early reverberation signal; (2) the late reverberation signal, e.g. the reverberation signal of the speaker's voice corresponding reverberation times of more than 50 ms; (3) the ambient noise, i.e., the noise from all other sources. By "speaker's voice," here, the speaker's voice as reproduced by the loudspeaker arrangement 24 is meant.

When the gain applied in the audio signal processing unit 20 is increased, both the level of the "useful signal" and the level of the "late reverberation signal" will increase, whereas the level of the "ambient noise" is independent of the speaker's voice level and hence will not increase when the gain is increased. However, of course, the ambient noise level may vary in time when, for example, some of the listeners 26 start talking, etc.

Figure 2:
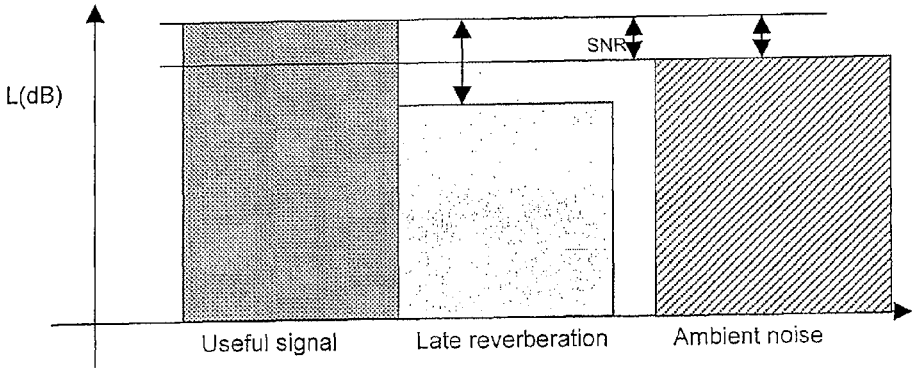
FIG. 2 is a diagram showing the levels of the useful signal, the late reverberation signal and the ambient noise signal in a condition when the gain of the speech enhancement system is too low.

FIG. 2 is a schematic representation of these three sound field components, wherein the level of the late reverberation signal is lower than the ambient noise level. In this case the signal to noise ratio (SNR), which is a measure of the speech intelligibility, is determined by the difference between the level of the useful signal and the ambient noise level.

Figure 3:
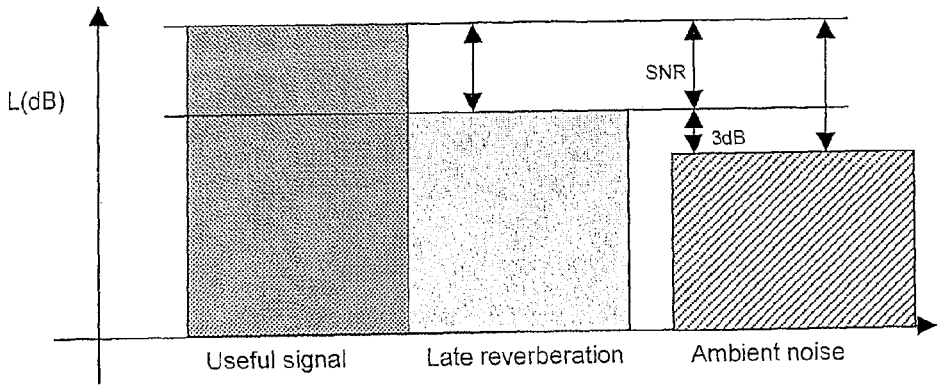
FIG. 3 is a diagram like FIG. 2, wherein a condition is shown when the gain of the speech enhancement system is optimal.

As shown in FIG. 3, the SNR can be increased by increasing the gain applied to the audio signals captured by the microphone 12, because thereby the level of the useful signal is increased, while the ambient noise level remains constant.

However, since the level of the late reverberation signal increases in parallel with the level of the useful signal, a further increase in gain will not result in a corresponding increase in SNR once the ambient noise is masked by the late reverberation signal. It can be assumed that such masking of the ambient noise occurs when the level of the late reverberation signals is at least about 3 dB higher than the level of the ambient noise. This situation is shown in FIG. 3, according to which the SNR is optimized when the gain is set to a value at which the level of the late reverberation signal is about 3 dB higher than the ambient noise level. As already mentioned above, further increase of the gain then will not result in an increase in SNR and hence should be avoided.

In order to optimize the gain (and hence the SNR), it is beneficial to estimate both the actual level of a reverberation signal, which is preferably the late reverberation signal discussed above, and the actual level of the ambient noise.

The threshold of the reverberation time from which on the sound components form part of the (late) reverberation level preferably is selected such that the late reverberation sound components are perceivable as a hearing sensation separate from the perception of the respective non-delayed sound. The threshold in practice corresponds to that reverberation time at which a sound component starts to create a hearing sensation perceived separately from that of the respective non-delayed signal. Typically, the threshold may be set at around 50 ms.

Whereas the ambient noise level is estimated from the audio signals captured by the microphone 12, the (late) reverberation level may be estimated either from the level of the processed audio signals, namely the level of the audio signals at the input of the power amplifier 22, (closed loop configuration) or from the level of the audio signals supplied to audio signal processing unit 20, i.e., from the level of the audio signals prior to being processed (open loop configuration).

Typically, gain changes slowly, with time constants on the order of about 5 s.

Figure 8:
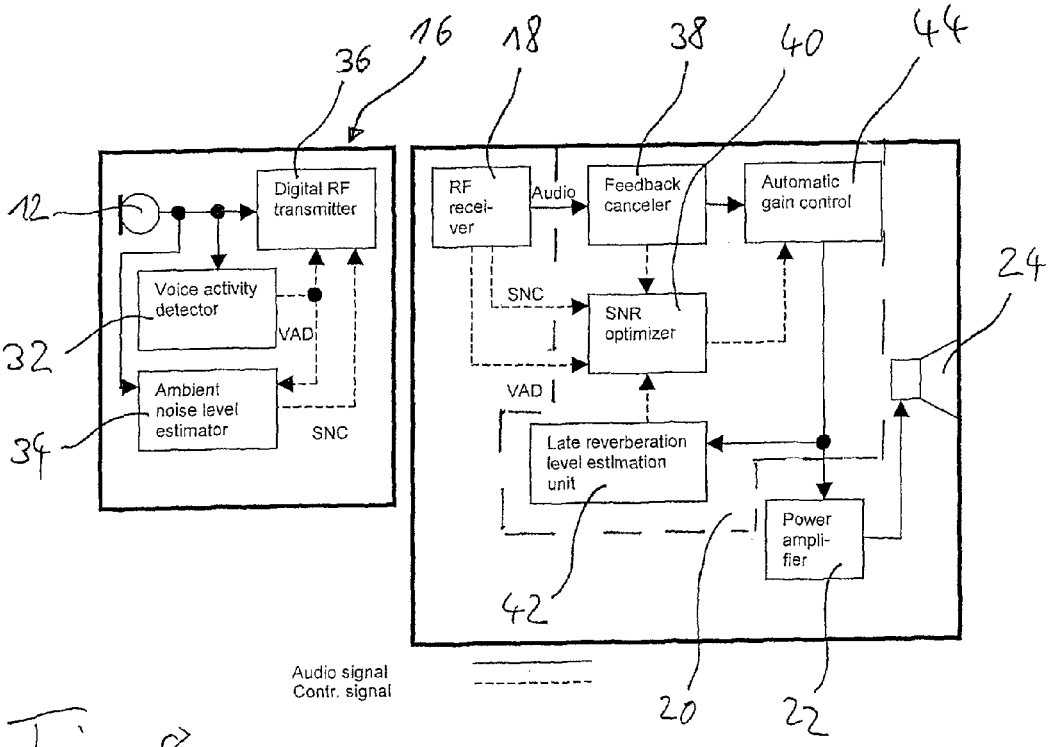
FIG. 8 is a block diagram of an example of a speech enhancement system according to the invention.

In FIG. 8, a first example of a speech enhancement system according to the invention is shown, wherein the system is designed as a wireless system, i.e., comprising a wireless audio link, preferably a digital link, for transmitting the audio signals from the microphone 12 to the loudspeakers 24. The system comprises a transmission unit 16 including the microphone 12, a voice activity detector (VAD) 32, an ambient noise level estimator 34 and an RF (Radio Frequency) transmitter 36, which may be digital.

The voice activity detector 32 analyzes the audio signals captured by the microphone 12 and determines whether the speaker 14 is presently speaking or not and outputs a corresponding VAD status signal. The ambient noise level estimator 34 is active only when the VAD signal supplied from the voice activity detector 32 indicates that the speaker 14 presently is not speaking. The ambient noise level estimator 34, when active, derives from the audio signals captured by the microphone 12, an ambient noise compensation (SNC) signal, which is indicative of the present ambient noise level.

The audio signals captured by the microphone 12, the VAD signal and the SNC signal are supplied to the transmitter 36 for being transmitted via a radio frequency (RF) link, such as an FM link, to an RF receiver 18, which supplies the received signals to the audio signal processing unit 20 which comprises a feedback canceller 38, a SNR optimizer 40, a late reverberation level estimation unit 42 and an automatic gain control unit 44. The audio signals received by the receiver 18 are supplied via the feedback canceller 38 to the automatic gain control unit 44, in order to be transformed into processed audio signals which are supplied as input to the power amplifier 22 which drives the loudspeaker arrangement 24. The late reverberation level estimation unit 42 uses the level of the processed audio signal supplied by the automatic gain control unit 44 to the power amplifier 22 for estimating the late reverberation level by taking into account acoustic room parameters.

In the embodiment of FIG. 8, the acoustic room parameters are fixed, i.e., factory-programmed, and are that of a typical room in which the loudspeaker arrangement 24 is to be used. Preferably, the late reverberation level is estimated by applying a correction factor derived from the acoustic room parameters to a level measurement of the audio signals at the input of the power amplifier 22.

The feedback canceller 38 analyses the audio signals received by the receiver 18 in order to determine whether there is a critical feedback level caused by feedback of sound from the loudspeaker arrangement 24 to the microphone 12 (Larsen effect). As a result the feedback canceller 38 outputs a status signal indicating the presence or absence of critical feedback, which status signal is supplied to the SNR optimizer 40, together with a signal indicative of the late reverberation level estimated by the unit 42 and the SNC and VAD signals received by the receiver 18. Based on the information provided by these input signals, the SNR optimizer 40 outputs a control signal acting on the automatic gain control unit 44 for controlling the gain, in order to optimize the SNR, as will be illustrated by reference to FIGS. 4 to 7.

Figure 4:
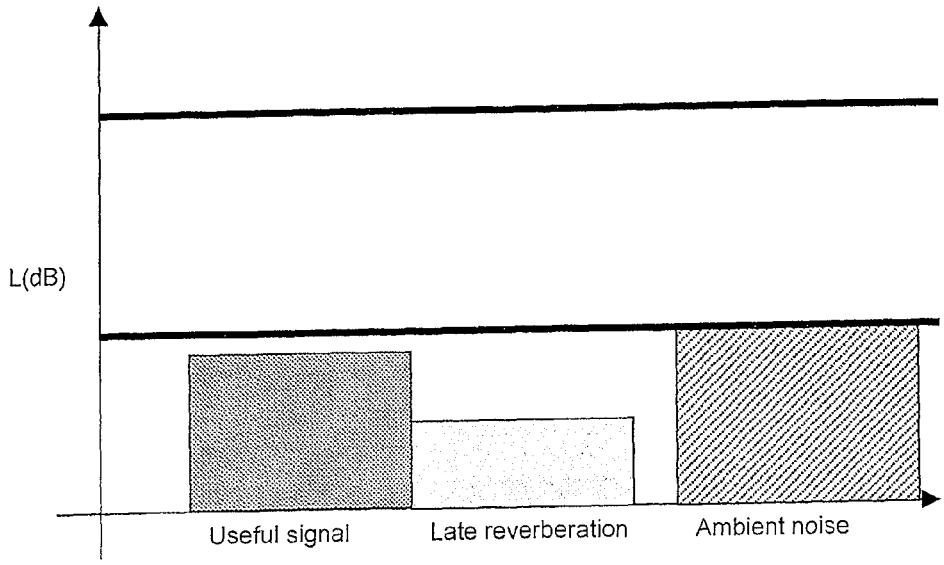
FIG. 4 is a diagram like FIGS. 2 and 3 showing a condition when the speaker is not speaking.
Figure 5:
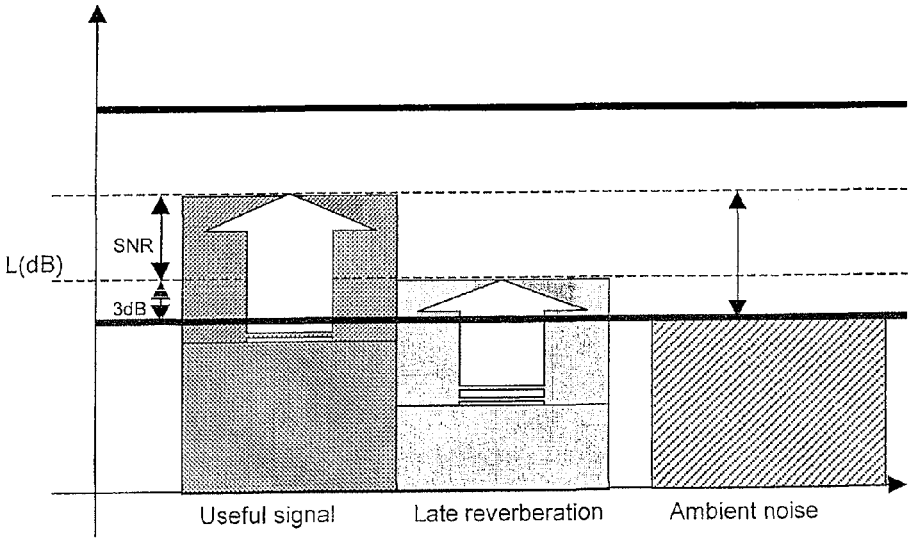
FIG. 5 is a diagram like FIG. 4 showing a condition when the speaker starts to speak.
Figure 6:
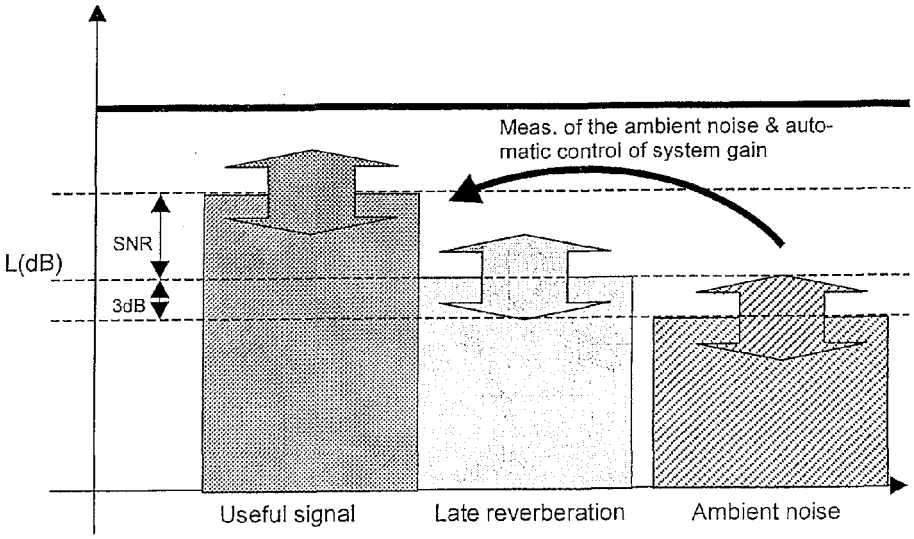
FIG. 6 is a diagram like FIG. 4 showing a condition when the ambient voice level changes with time.
Figure 7:
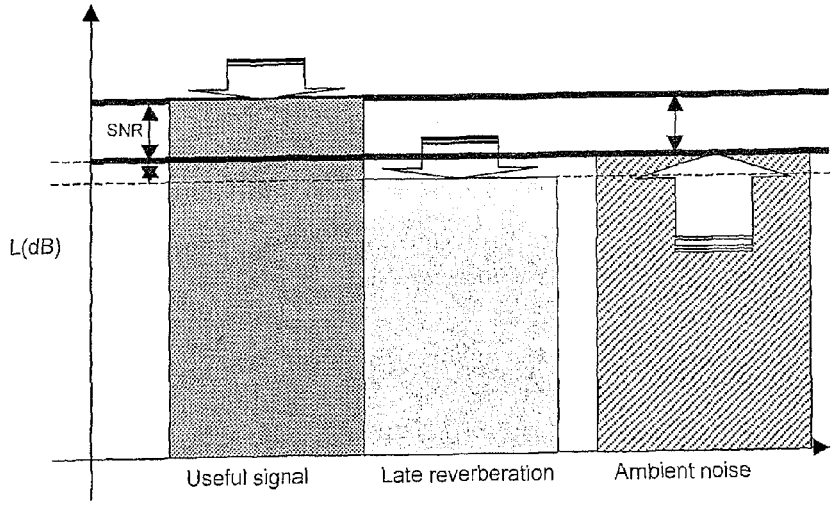
FIG. 7 is a diagram like FIG. 4 showing a condition when the beginning of feedback has been detected.

During times when the VAD signal indicates that the speaker 14 is not speaking, the ambient noise estimator 34 determines the ambient noise level (SNC-signal) from the audio signals presently captured by the microphone 12. This situation is shown in FIG. 4; at the position of the listeners 26 the ambient noise is dominant.

During times when the VAD signal indicates that the speaker 14 is speaking, the gain is increased to the ambient noise level expected to be masked by the late reverberation level. For example, the gain may be increased until the late reverberation level is about 3 dB above the ambient noise level, see FIG. 5.

When the ambient noise level estimator 34 determines that the ambient noise level has changed, the gain will be adjusted by the SNR optimizer 40, with a certain time constant, to the presently estimated ambient noise level. In other words, when the ambient noise level is found to decrease, the gain is decreased accordingly, and when the ambient noise level is found to increase, the gain is increased accordingly, see FIG. 6. Thereby, the SNR can be optimized at any time.

However, for high ambient noise levels it might be necessary to increase the gain to a value at which the system starts to have feedback problems. Once such condition is determined by the feedback canceller 38, a further increase of the gain will be stopped by the SNR optimizer. Under such conditions, the ambient noise level may become higher than the late reverberation level, so that the SNR then will be lower than at lower ambient noise levels, see FIG. 7.

Figure 12:
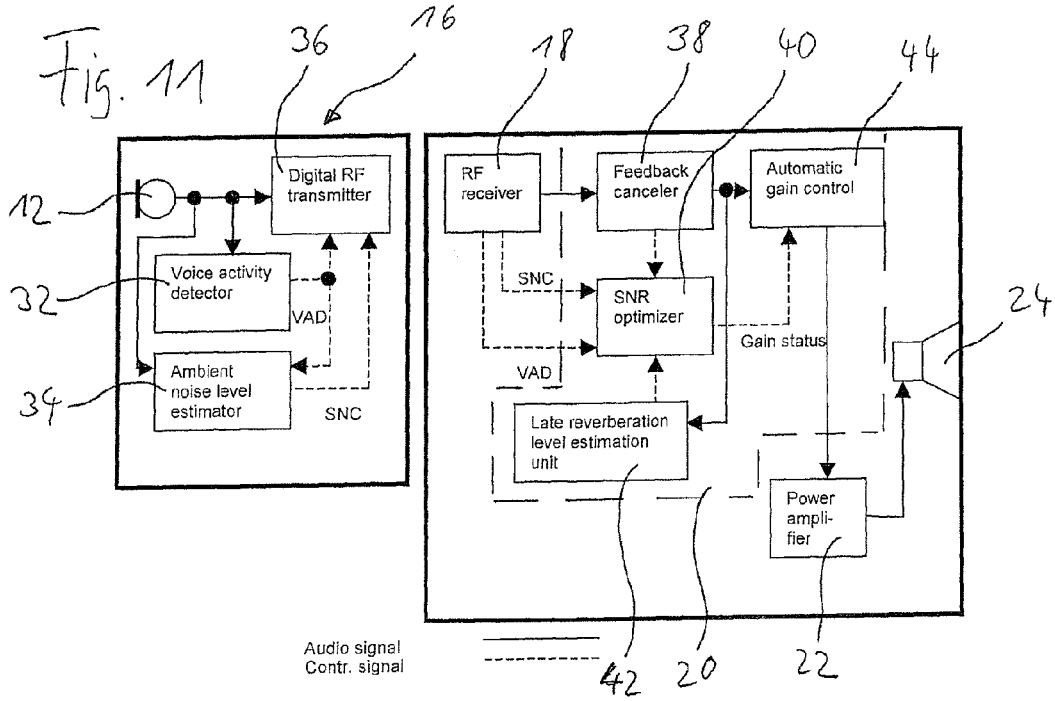
FIG. 12 is a block diagram like FIG. 8, wherein a modified version is shown.

While FIG. 8 shows an embodiment having a closed loop configuration (the late reverberation level is determined from the processed audio signals at the output of the automatic gain control unit 44), FIG. 12 shows the embodiment of FIG. 8 as modified to an open loop configuration, wherein the reverberation level is determined from the (non-processed) audio signals at the input to the automatic gain control unit 44.

Figure 9:
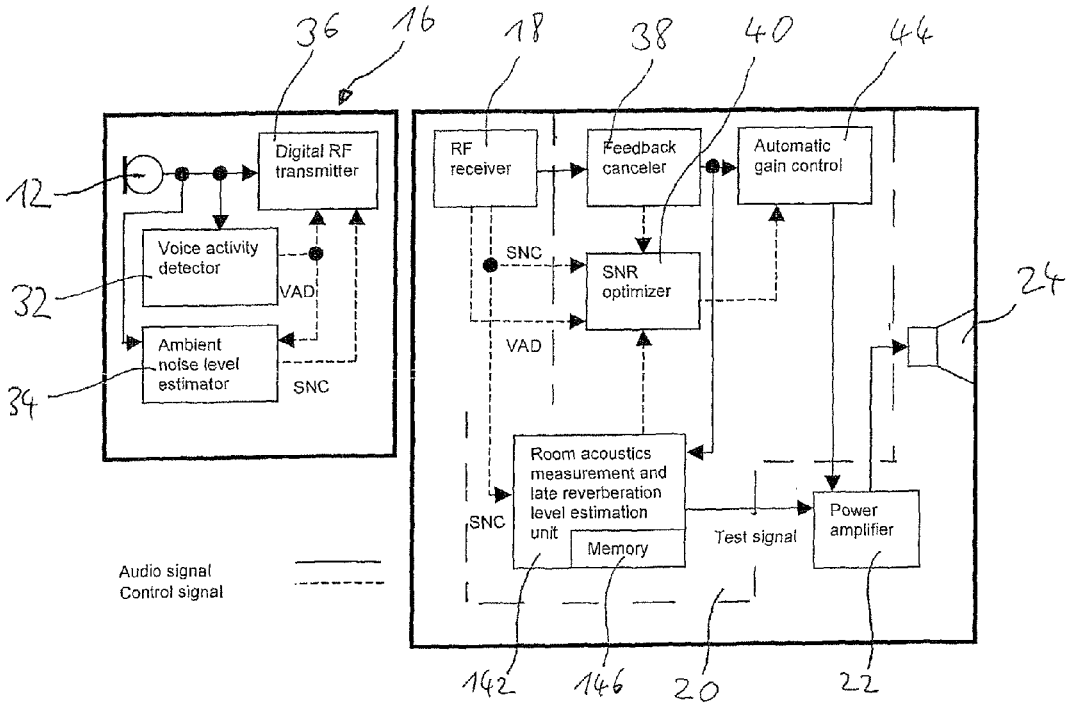
FIG. 9 is a block diagram of an alternative example of a speech enhancement system according to the invention.

In FIG. 9, the block diagram of another modified system is shown, wherein, for estimating the late reverberation level, acoustic parameters of the actual room in which the system is used are determined from a measurement carried out in a calibration mode prior to using the system for speech enhancement. According to the embodiment of FIG. 9, the acoustic room parameters are determined by measurement of the level of the reverberant field in the room. To this end, the user places the microphone 12 at a position in the room 10, which position is dominated by the reverberant sound from the loudspeaker arrangement 24, and launches an automatic calibration procedure. According to the embodiment of FIG. 9 the late reverberation level estimation unit 42 of the embodiment of FIG. 8 is replaced by a unit 142 which serves to both determine the acoustic parameters of the room and to estimate the late reverberation level.

In the calibration mode, the unit 142 generates a test signal which is supplied via the power amplifier 22 to the loudspeaker arrangement 24 for reproducing a corresponding test sound which is captured by the microphone 12 as test audio signals from which the SNC signal, which corresponds to the level of the test sound, is derived by the ambient noise level estimator 34, with the SNC signal being supplied to the unit 142. The unit 142 analyzes the SNC signal corresponding to the test signal level, and a ratio of the level of the signal at the input of the power amplifier 22 and the test audio signal level determined by the unit 142 is calculated and stored in a memory 146 connected to the unit 142.

In other words, in the calibration mode, a test signal having a known level is generated via the loudspeaker arrangement 24, the test signal is captured by the microphone 12, and the correction factor to be applied to the level of the processed audio signals at the input of the power amplifier 22 in order to estimate the late reverberation level is determined from the level of the test audio signals captured by the microphone 12. In the speech enhancement mode of the system, the correction factor us retrieved from the memory 146.

The system of FIG. 9 is an open loop system, i.e., like in the system of FIG. 12, the reverberation level is determined from the (unprocessed) audio signals at the input to the automatic gain control unit 44.

Figure 10:
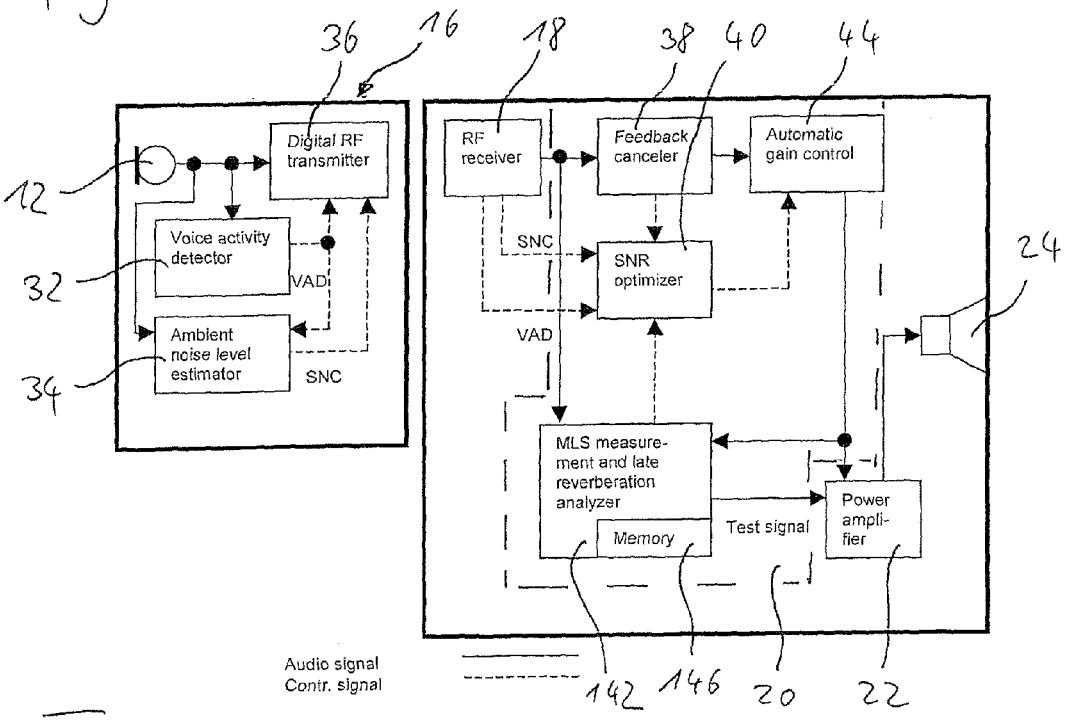
FIG. 10 is a block diagram of a further alternative example of a speech enhancement system according to the invention.

In FIG. 10, an embodiment is shown wherein, in the calibration mode, the acoustic room parameters are determined by measurement of the impulse response of the room 10 rather than by measurement of the level of the reverberant field in the room 10 as realized in the embodiment of FIG. 9. In this case, in the calibration mode the microphone 12 may be placed at any position in the room, and the unit 142 generates a maximum length sequence (MLS) test signal at a known level, which is supplied via the power amplifier 22 to the loudspeaker arrangement 24 for reproducing a corresponding test sound which is captured by the microphone 12. The captured test audio signals are supplied via the wireless link to the unit 142. In the unit 142, a convolution of the captured test audio signals is performed in order to obtain the impulse response of the system in the room 10, wherein only the level of the late reverberation sound components, e.g., test sound components corresponding to reverberation times of more than 50 ms, are taken into account.

In other words, the correction factor to be applied to the level of the processed audio signals at the input of the power amplifier 22 is determined from the level of the late reverberation components of the test audio signals as captured by the microphone 12. To this end, a ratio of the audio signal level at the input of the power amplifier 22 (i.e., the level of the processed test audio signals) and the late reverberation level of the test audio signals as measured by the unit 142 is calculated and stored in the memory 146. In the speech enhancement mode, the value stored in the memory 146 then is used to estimate the late reverberation level from the audio signal level at the input of the power amplifier 22.

Although the system of FIG. 10 is shown as a closed loop system, alternatively, it could be designed as an open loop system.

Figure 11:
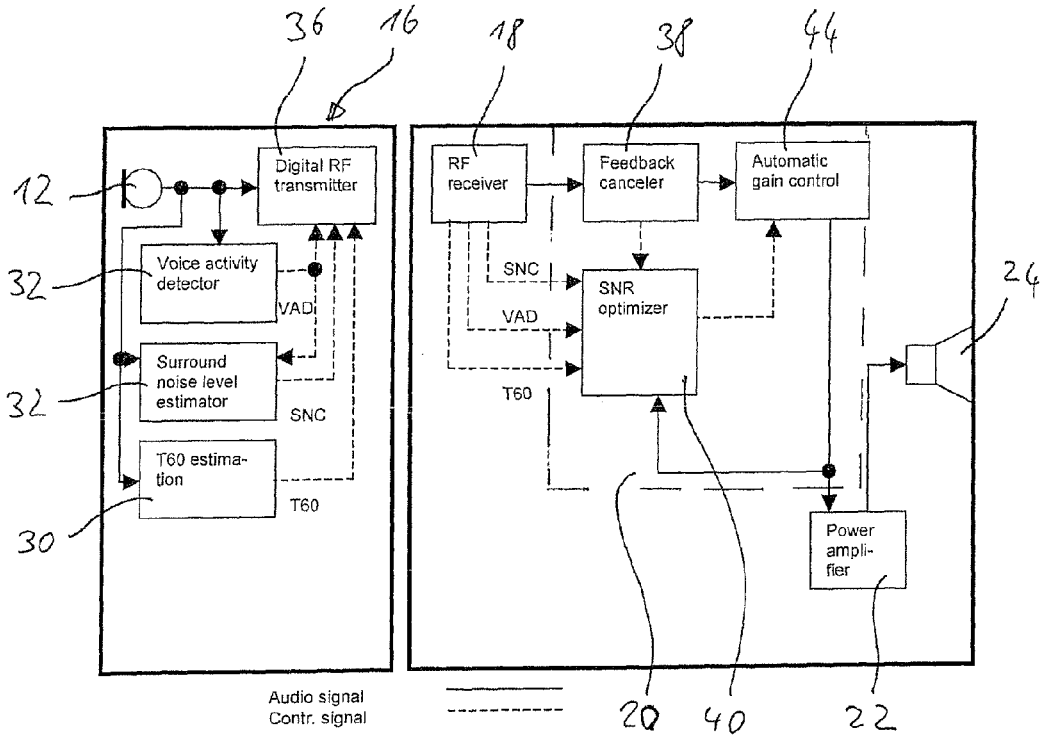
FIG. 11 is a block diagram of a still further alternative example of a speech enhancement system according to the invention.

In FIG. 11, an embodiment is shown wherein an in-situ determination of the acoustic parameters of the actual room 10, in which the system is used, is enabled during speech enhancement operation, without a calibration mode being necessary. In this case, the transmission unit 16 includes a reverberation time estimation unit 30, which is able to determine a reverberation time of the room, such as RT60, from the audio signals captured by the microphone 12 during speech enhancement operation, i.e., when the speaker 14 is speaking (RT60 is the time needed for the reverberant field in the room to decrease by 60 dB after an impulse noise; usually, RT60 is determined as a function of frequency). The RT60 value determined by the reverberation time estimation unit 30 is supplied to the transmitter 36 for being transmitted via the receiver 18 to the SNR optimizer 40. The SNR optimizer 40 creates a set of acoustic room parameters according to the RT60 measurement and estimates the late reverberation level by using a corresponding correcting factor applied to the level of the processed audio signals at the input of the power amplifier 22.

Although the system of FIG. 10 is shown as a closed loop system, alternatively, it could be designed as an open loop system.

In all embodiments, the transmission unit 16 may be compatible with hearing aids having a wireless audio interface, such as hearing aids having an FM receiver unit connected via an audio shoe to the hearing aid or hearing aids having an integrated FM receiver.

While various embodiments in accordance with the present invention have been shown and described, it is understood that the invention is not limited thereto, and is susceptible to numerous changes and modifications as known to those skilled in the art. Therefore, this invention is not limited to the details shown and described herein, and includes all such changes and modifications as encompassed by the scope of the appended claims.

What is claimed is:

1. A method of speech enhancement in a room, comprising capturing audio signals from a speaker's voice by a microphone, estimating an ambient noise level in the room from the captured audio signals, processing the captured audio signals by an audio signal processing unit, estimating a reverberation level, determining a gain to be applied to the captured audio signals by the audio signal processing unit according to a comparison between the estimated ambient noise level and the estimated reverberation level, and generating sound according to the processed audio signals by a loudspeaker arrangement located in the room, wherein the reverberation level is the level of reverberant components of the sound generated by the loudspeaker arrangement.

2. The method of claim 1, wherein the reverberation level is estimated from a level of the processed audio signals or from a level of the audio signals supplied to audio signal processing unit.

3. The method of claim 2, wherein the processed audio signal undergo amplification at constant gain by a power amplifier prior to being supplied as input to the loudspeaker arrangement as amplified processed audio signals.

4. The method of claim 1, comprising the further step of determining whether the speaker is presently speaking or not from the captured audio signals using a voice activity detector, and wherein the ambient noise level is estimated from a level of the audio signals captured during times when it has been determined that the speaker is not speaking.

5. The method of claim 4, wherein, during times when it has been determined that the speaker is speaking, the gain is increased to a level at which the ambient noise level is expected to be masked by the reverberation level.

6. The method of claim 5, wherein the gain is limited to a maximum value corresponding to a gain at which the reverberation level exceeds the ambient noise level by a given threshold value.

7. The method of claim 6, wherein the threshold value is 3 dB.

8. The method of claim 1, wherein it is determined, by a feedback canceller, whether a gain applied by the audio signal processing unit causes a critical feedback level, and wherein, when a critical feedback level has been determined, the gain applied by the audio signal processing unit is limited to values which do not cause a critical feedback level.

9. The method of claim 1, wherein the reverberation level is estimated from a level of the processed audio signals by using acoustic room parameters.

10. The method of claim 9, wherein the reverberation level is estimated from a level of the processed audio signals by applying a correction factor derived from the acoustic room parameters to a level measurement at an input of the power amplifier.

11. The method of claim 9, wherein the acoustic room parameters are fixed and are that of a room having characteristics similar to those expected to exist in the room in which the loudspeaker arrangement is to be used.

12. The method of claim 9, wherein the acoustic room parameters are determined in-situ in a calibration mode prior to starting speech enhancement operation.

13. The method of claim 12, wherein the acoustic room parameters are determined by measurement of a level of the reverberant field in the room.

14. The method of claim 13, wherein, in the calibration mode, the microphone is placed at a position in the room which is dominated by reverberant sound from the loudspeaker arrangement, a test signal with a known level is generated via the loudspeaker arrangement, the test signal is captured by the microphone, and a correction factor is determined from a level of the test audio signals captured by the microphone.

15. The method of claim 12, wherein the acoustic room parameters are determined by measurement of an impulse response of the room.

16. The method of claim 15, wherein, in the calibration mode, the microphone is placed at any position in the room, a maximum length sequence test signal is generated at a known level via the loudspeaker arrangement, the test signal is captured by the microphone, and a correction factor is determined from a level of late reverberation components of the test signals as captured by the microphone.

17. The method of claim 9, wherein the acoustic room parameters are determined in-situ during speech enhancement operation, wherein a reverberation time of the room is estimated from captured voice signals, and wherein the acoustic room parameters are derived from the determined reverberation time.

18. The method of claim 1, wherein the captured audio signals are transmitted via a wireless link to the audio signal processing unit.

19. The method of claim 1, wherein the reverberation level is a late reverberation level corresponding to a level of the components of the sound generated by the loudspeaker arrangement having reverberation times above a reverberation time threshold, which threshold is selected such that late reverberation sound components are perceivable as a hearing sensation separate from perception of respective non-delayed sound.

20. The method of claim 19, wherein the reverberation threshold time is about 50 ms.

21. A system for speech enhancement in a room, comprising a microphone for capturing audio signals from a speaker's voice, an audio signal processing unit for processing the captured audio signals a loudspeaker arrangement to be located in the room for generating sound according to the processed audio signals, and means for estimating an ambient noise level in the room from the captured audio signals, wherein the audio signal processing unit comprises means for estimating a reverberation level and means for determining a gain to be applied to the captured audio signals by the audio signal processing unit according to a comparison between the estimated ambient noise level and an estimated reverberation level, wherein the reverberation level is the level of reverberant components of the sound generated by the loudspeaker arrangement.

22. The system of claim 21, wherein the system comprises a power amplifier for amplifying, at constant gain, the processed audio signals in order to produce amplified processed audio signals to be supplied to loudspeaker arrangement.

23. The system of claim 22, wherein said means for estimating is adapted to estimate the reverberation level from a level of the processed audio signals prior to supplying thereof to the loudspeaker arrangement as the amplified processed audio signals.

24. The system of claim 21, wherein the microphone forms part of a transmission unit comprising a voice activity detector for analyzing the captured audio signals for outputting a voice activity status signal indicating whether the speaker is presently speaking or not, an ambient noise level estimator for estimating said ambient noise level and for outputting an ambient noise level signal indicating the estimated ambient noise level, and a transmitter for transmitting the captured audio signals, the voice activity status signal and the ambient noise level signal via a wireless link to a receiver unit comprising a receiver for receiving the signals transmitted by transmitter and the audio signal processing unit.

25. The system of claim 24, wherein the transmission unit is compatible with hearing aids having a wireless audio interface.

* * * * *